US005203557A

United States Patent [19]

Studebaker et al.

[11] Patent Number: 5,203,557

[45] Date of Patent: Apr. 20, 1993

[54] BASEBALL BASE AND ANCHOR

[76] Inventors: Charles E. Studebaker, 5753 Greendale Dr., Galloway, Ohio 43119; William Weigl, 1805 Conwood Dr., Troy, Ohio 45373

[21] Appl. No.: 822,684

[22] Filed: Jan. 21, 1992

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 75,076 | 3/1868 | Taylor | 273/25 |
| 171,038 | 12/1975 | O'Neill . | |
| 2,084,775 | 6/1937 | Orefice | 273/25 |
| 2,624,580 | 1/1953 | Corbett | 273/25 |
| 2,695,784 | 11/1954 | Orsatti et al. . | |
| 3,204,958 | 9/1965 | Velasquez . | |
| 3,508,747 | 4/1970 | Orsatti . | |
| 3,572,705 | 3/1971 | Wyble | 273/25 |
| 4,723,779 | 2/1988 | Hausen | 273/25 |
| 4,817,946 | 4/1989 | Valesquez | 273/25 |
| 4,979,740 | 12/1990 | Hall | 273/25 |

*Primary Examiner*—Theatrice Brown

[57] ABSTRACT

The anchor utilizes a pair of horizontally-offset male/-female connections between the base and the anchor, the outer one of which connections is adjacent the outer edges of the base so as to minimize the effects of torque applied as when a player slides into a base while attempting a "steal". The horizontal surface area of the anchor is relatively large to enable a dirt-covered anchor to be easily located. Important advantages of the design are to avoid anchor obstruction of dragging equipment when the bases are removed, protecting both the equipment and the anchors, and to minimize risk to a player stepping over an anchor which does not have a base covering it.

18 Claims, 3 Drawing Sheets

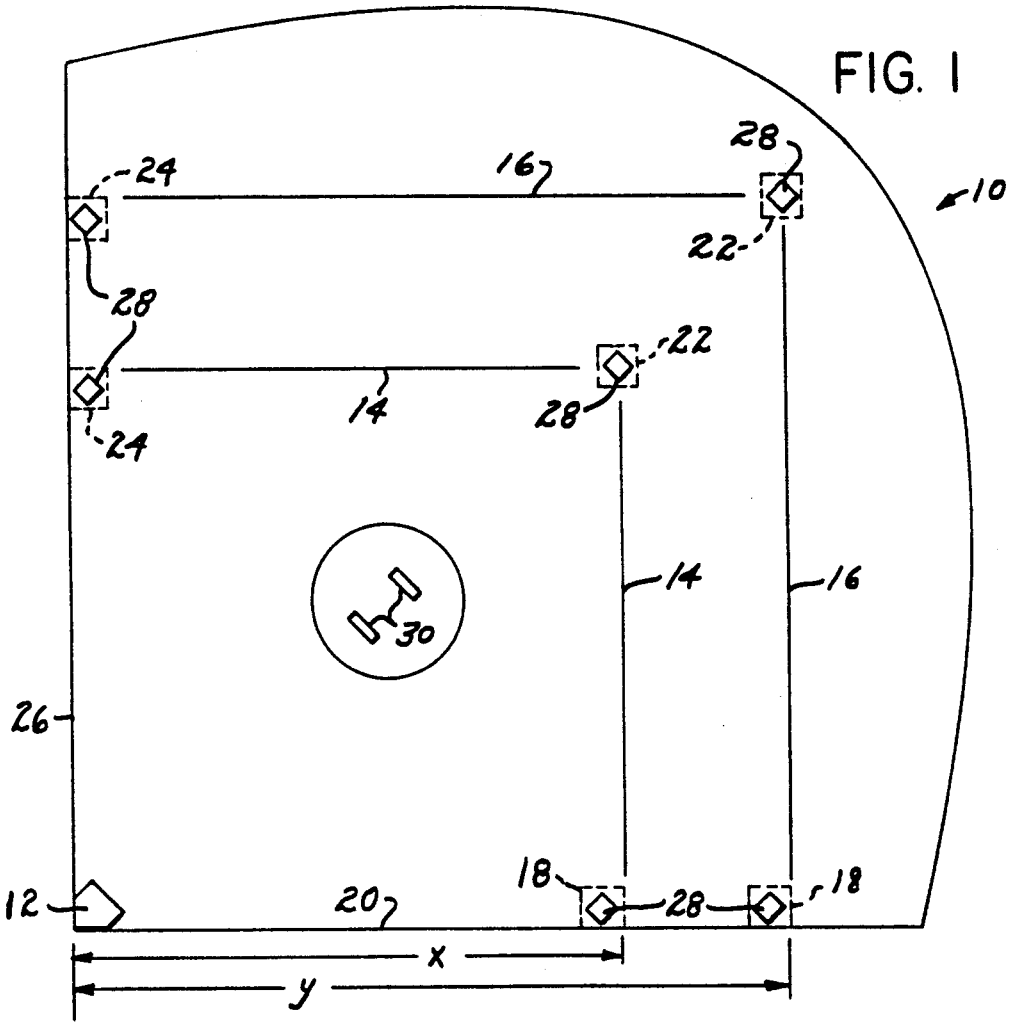
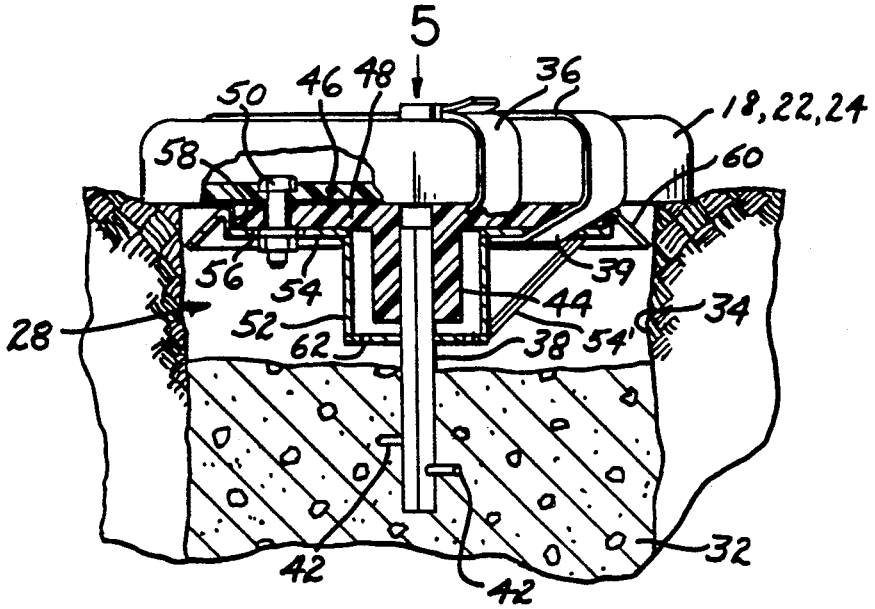
FIG. 2

FIG. 6
PRIOR ART
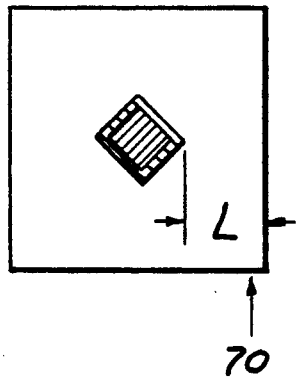
FIG. 7
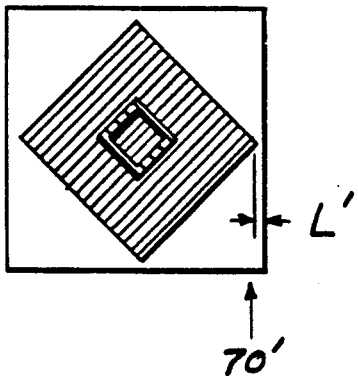
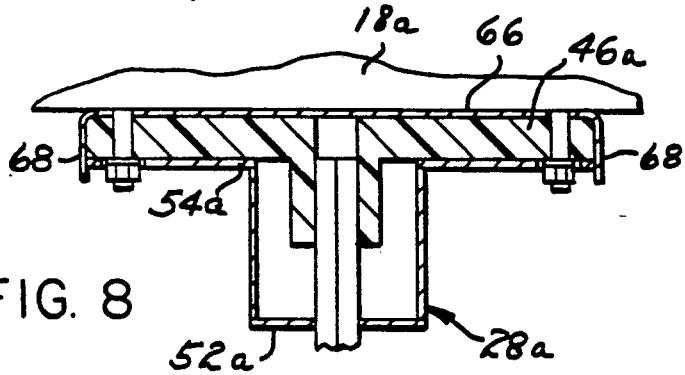
FIG. 8
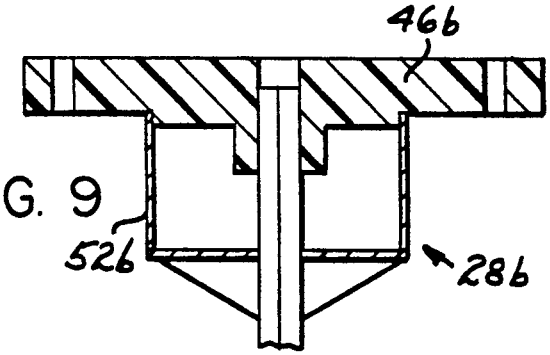
FIG. 9
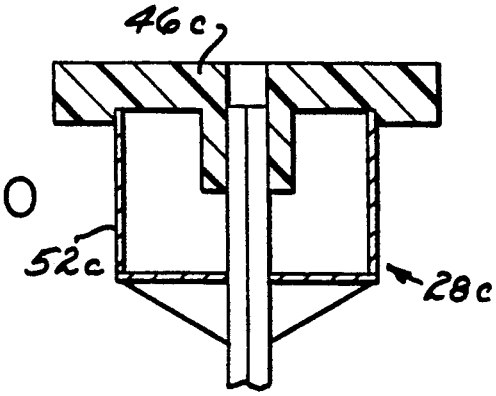
FIG. 10

BASEBALL BASE AND ANCHOR

This invention relates to novel base anchors located beneath grade on basepaths of a baseball diamond and to a method for utilizing the bases as locating tools when initially permanently positioning the anchors at their proper levels and angles.

BACKGROUND OF THE INVENTION

A number of different kinds of bases and base anchors are in use and are known in the patent art. Most typically, those in use include a stake in the ground, with the top of the stake being below grade from one-fourth to three-fourths of an inch. A female receptacle on the underside of each base fits over its stake. After each game, the bases are removed and the basepaths leveled by dragging equipment. Although anchors are known which have a top area which is large enough to make their being located fairly simple by poking a shovel in the dirt, most consist of a single square male stake about one inch across. The stakes at the first and third base locations are generally easy to find by measuring the distance from home plate. Finding such a stake at the second base location is another matter, however. When found, surrounding earth must be dug away from the stakes so that the mating receptacles on the underside of the base are unobstructed when placing the receptacles over the stakes. While most stakes are likely male members, some are female with the mating male part being on the base. Female stakes must be protected from entrance of dirt when the bases are removed. If not so protected, it becomes necessary to clean dirt from a one-inch hole in the female stake. This can be difficult and time consuming. Some female stakes have a hinged cover, while others have a plug inserted into the stake opening. Both such designs are subject to being contacted and snagged by the dragging equipment, causing the dirt covers to be yanked off, enabling dirt to get into the female openings and risking damage to the dragging equipment.

One problem with designs which consist of standard single male/female connections is that the torque or twisting load applied to a base, e.g., as when a player is sliding while "stealing" a base, can be quite severe. This torque is applied about a lever arm of a length approximately one-half of the width of a standard fifteen inch base when the sliding player's foot contacts an outside corner of the base. While most bases are made to withstand wear and tear as well as sliding torque, damage can and does occur to the attaching parts, often to the point where the bases must be replaced.

A further problem surrounds the various makeshift techniques of anchoring the stakes in their permanent positions in the basepaths. Oftentimes the stakes are fixed upright in large cans of concrete, holes dug for the cans and the cans buried, hopefully to the correct depth and with the stakes in their true vertical positions. Sometimes the stakes are merely driven into the ground with a sledge hammer.

SUMMARY OF THE INVENTION

An anchor for a base located in a basepath of a baseball diamond is permanently mounted below grade so as not to interfere with conventional dragging equipment used to level the basepath. The anchor includes an upstanding male stake surrounded by an open-topped housing in which is received a female receptacle fastened to the underside of a base. The upper open end of the housing generally coincides with the upper end of the stake, with a flange extending laterally from the open end of the housing. At the periphery of the flange, a second upright restraining portion or surface is provided to become part of a second male/female connection between the base and anchor when the two are connected. This upright portion receives the outer edge of a flange forming part of an anchor plate fastened to the base, which anchor plate also includes the female receptacle which fits over the stake. This outer edge of the anchor plate flange and the inside edge of the upright restraining portion of the flange on the anchor thus take the main brunt of a slide into the base by a player. Depending on the particular design, such a connection can reduce the torque applied to the base and anchor from a slide thereinto by as much as one-third from a conventional anchoring system.

Also provided is a technique and method for initially locating the bases in their proper positions when the diamond is being prepared for one or more different leagues. The bases and anchors are strapped together or otherwise connected in a fashion which allows them to be disconnected from above once the base anchors have set in a concrete footer.

Particularly for a baseball diamond used by two or more different leagues such as by a Pony League or Colt League, the bases are located different distances apart. Thus when being used by one league, the anchors positioned for the other league can be an obstruction problem for players, particularly for infielders who may have to step on the exact location of an unused anchor while fielding a ball, even though the anchor is located a fraction of an inch below grade. Since the cleats of the player's shoes may penetrate below the surface and contact an anchor from the other league's basepath, a cover plate is provided over the anchor. The cover plate of this invention is provided with a resilient surface to prevent cleat contact therewith from causing the player to lose his footing.

It is therefore an object of my invention to provide a base anchor which is less subject to damage from sliding into the base than prior art anchors.

Another object is to provide such an anchor which has a large resilient horizontal surface area to enable easy locating when placing bases onto the diamond, but to have such surface area relatively safe when a player contacts an anchor during play.

A further object is to provide a method of locating the bases initially by utilizing the bases themselves as tools for properly positioning the anchors at their correct depths and vertical alignment.

Still another object is to provide a base anchor design which minimizes damage to the anchors and dragging equipment when leveling the field.

Other objects and advantages will become apparent from the following description, in which reference is made to the accompanying drawings.

BRIEF DESCRIPTION OF THE DRAWINGS

FIG. 1 illustrates a layout of a baseball diamond which is adapted for use by more than a single league, and therefore has bases located at different distances according to the different leagues using the diamond.

FIG. 2 is a vertical cross-sectional fragmentary view of a base and anchor showing how they are interconnected when initially being installed in a concrete footer below grade. The view is taken substantially along lines 2—2 of FIG. 5.

FIGS. 6 and 7 are prior art and present invention comparisons respectively of the different lever arms of the two designs.

FIGS. 8, 9 and 10 illustrate alternative embodiments of the interconnecting elements of a base and base anchor which utilize a primary feature of our invention.

DESCRIPTION OF THE PREFERRED EMBODIMENT(S)

Figure 3:
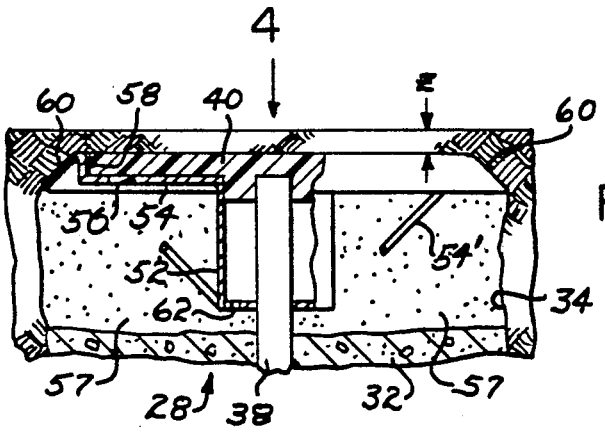
FIG. 3 is a vertical view similar to FIG. 2, but with the base removed, the anchor covered with a cover plate and earth or dirt covering the anchor to enable dragging to be performed.
Figure 4:
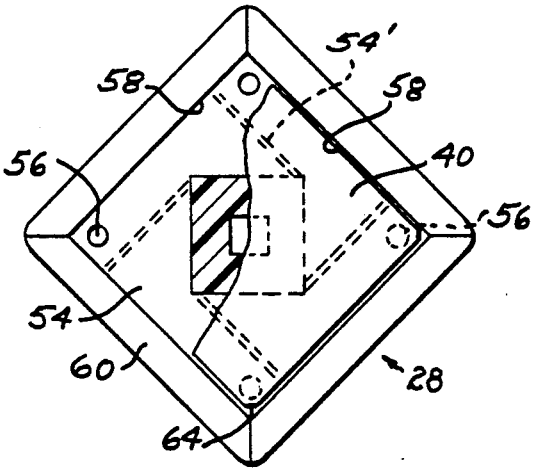
FIG. 4 is plan view of the base anchor taken looking in the direction of the arrow 4 of FIG. 3, with dirt removed.

FIG. 1 is a plan view of a baseball diamond 10 having a home plate 12 which is common to two different sets of dirt or earth basepaths 14 and 16 which may be used for Pony League and Colt League play respectively. Distance "x" for the Pony League is 75 feet in length while distance "y" for the Colt League is 85 feet. While reference will be made to the game of baseball herein, it is to be understood that the term also includes the game of softball. Furthermore, the same diamond 10 may possibly be used with basepaths for softball, Little League and adult league play as well, the two basepath dimensions illustrated herein being for explanation purposes only. The customary bases are first base 18 along a first base line 20, second base 22 and third base 24 along a third base line 26. Two each of bases 18, 22 and 24 are shown, it being understood that only one set is used at a time, depending on which league is playing. While one league is playing, however, the other set of base anchors 28 is not in use and must be below grade. As will be explained later, the unused set of anchors 28 must not interfere with fielding players or base runners, and should not only be below the surface of the playing field, but, in the event an anchor is exposed either because of dirt being worked up during play of a game or insufficient dirt remaining over the anchor after grading has been completed, players should be protected from potential injury if they come into contact with the upper surface of an anchor due to cleats on their shoes penetrating the earth.

To illustrate the locating of sets of anchors for the different leagues, the dimension x and y are relatively easy to measure and establish along the first and third base lines 20 and 26. It requires more attention and deliberation to locate second base 22, however. This is true not only during originally positioning the anchors in the basepaths 14 and 16, but also in locating the anchors for base installation at each change of the bases. It is common for each league (and sometimes each team) to have its own bases, thus the bases are removed from the anchors after each game or each league's play. The field is then dragged by equipment typically pulled behind a tractor before its next use. Different kinds of equipment may be used for dragging, a frequently employed version being a board with a portion of a so-called chain link fence attached to its underside. Before dragging can take place effectively, the bases must be removed and the anchors covered. Once dragging has been completed, the anchor positions must be found, usually by poking in the dirt where the anchors are believed to be located. Typically, the anchors are nothing more than a stake driven in the ground or anchored in a can of concrete and set into a hole in the ground. Finding such stakes, which may only be one inch square in cross-section, is not too difficult at first and third base, because it is known that they are approximately seven inches from the outer edges of lines 20 and 26. Marks are usually made to establish dimensions x and y also and the stakes would be about seven inches toward home plate from such marks. Locating the anchor for second base 22 is another matter, however. There are no lines such as 20 and 26 to gauge to. One must seek the location of the covered anchor by standing at the approximate second base location, facing home plate and lining up home plate 12 with a pitcher's box 30. It is then necessary to try to establish when the back edges of first base and third base are at a forty-five degree angle on each side of the person's line of sight across the pitcher's box and home plate. Since it is easier to estimate a right angle than one of forty-five degrees, the person typically walks toward or away from home plate while retaining the line of sight, guessing when first and third bases are at a right angle from his position on the playing field. Then comes the task of probing in the dirt for the small stake, or as will be shown in connection with the design of this invention, for the much larger surface area of the anchor 28. This can be done with a shove or other probing instrument. The larger surface of this invention also has the advantage that after the field has been wetted as by rain, the area over the anchor, due to its larger surface, dries out faster than the small surface area of the standard one-inch stake and can often be located by virtue of its being beneath a dry or drier patch of the earth.

Figure 5:
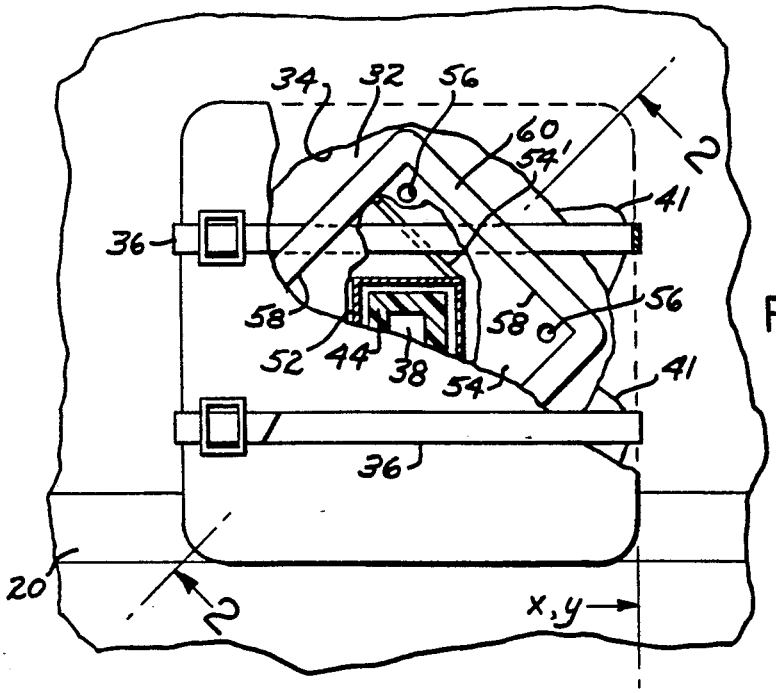
FIG. 5 is a fragmentary plan view taken looking in the direction of arrow 5 of FIG. 2, illustrating how a base can be used as a locating tool for placing the anchor in concrete in a first or third base position along a chalk line.

The illustration of FIG. 2 serves a twofold purpose, first to show a base mounted in position for play and second to also show how the base and anchor are connected by strapping them together when initially installing the bases in a concrete footer 32. Since the anchors 28 must be installed before they can be used for play of the game of baseball, let us assume the infield is about to be laid out for Pony League base positioning. Let us also assume that home plate and the first and third base lines have already been put in place, since this invention has no bearing on how that is accomplished. Dimension x is first measured along both the first and third base lines and appropriately marked at the outside edge of the lines 20 and 26. These lines are typically about two and one-half inches wide. Then, the same distance x is measured from both first and third bases toward what is to become the center of second base. That will become the center of a hole 34 dug to receive the concrete footer 32. Similar holes will also be dug for the other two bases, with the centers of the holes being approximately seven inches inward from the outside edges of the lines 20 and 26 and also from the back edges of the bases 18 and 24 toward home plate. Since the top surface of the anchor is to be below grade, an area perhaps two feet in diameter is scraped from the surface of the basepath where the anchor is to be placed, this then becoming the resting surface for the underside of the bases for purposes which will become apparent. The hole 34 can be dug as deep as desired, preferably below the frost line in colder climes, but at least deep enough so that the concrete will not shift or heave due to cold weather between seasons. Next, a pair of buckled straps 36 can be passed around a combined base and anchor as shown in FIGS. 2 and 5. After mixing and filling each hole with wet concrete to a level about four to five inches below the surface on which the base is to rest, the attached anchor and base are positioned as shown in FIG. 2. When placing first and third bases in their locations, one edge of each base is aligned with the outside edge of the associated baseline and the back edge of the base is gauged by whatever mark was used to establish dimension x. The strapped base thus becomes the locating tool for positioning the bases at their correct distances from home plate, and also assures that a stake 38 of each anchor be as near true vertical as possible. To accommodate the angle of the straps as seen at 39, a shovel may be used to make a relief 41 as shown in FIG. 5. Preferably, the surface on which the bottom of the base rests while the concrete is setting or curing has been leveled with a standard level beforehand, but this can be "eyeballed" after the base is in position and a bit of dirt either removed or added as desired to get what appears to be a level base condition.

For accurately positioning second base, since the center of the base is aligned with the back edges of first and third, it may be convenient to extend a mason's string from both first and third and have them pass beyond the second base position one foot or so to establish centerline marks beyond the outside edges of where second base is to be located. When the hole is dug for second base and the base and anchor are strapped together as for the others, the base may be centered using those marks and its edges squared by sight with first and third base. For cost reasons, it may be preferred to use twine instead of the straps 36, and merely tie the bases and their anchors together. Since the straps or twine have but a single purpose of holding the parts together while the concrete is curing, it is unnecessary to go to any great expense. Additionally, if rubber cords of the proper length are available, they can pass under and around the anchor and base and be hooked together above the base.

Now that we have anchors in place, let us describe the novel base anchor 28. Both FIGS. 2 and 3 show the anchor in vertical cross-section, FIG. 2 having a base such as 18, 22 or 24 attached thereto and FIG. 3 illustrating the base removed and replaced by a cover plate 40 which is covered with dirt. A primary element of the anchor is the stake 38, the lower end of which is affixed in the concrete footer 32. To assist in the anchoring of the stake 38 in the concrete, a pair of offset cross pins 42 are located near the bottom of the stake. Stake 38 is square in cross-section, but may be any shape which makes the base non-rotational when a female receptacle 44 depending from an anchor plate 46 is placed in mating position over the stake. Anchor plate 46 is preferably of molded plastic and also includes a flange 48 surrounding the receptacle and integral therewith. The plate 46 can be fastened to the underside of the base by means of bolts 50. The typical construction is to have the bolt threaded ends extend beyond the flange 48, with a washer and nut protruding beyond the lower surface of the plate 46.

A housing 52 is welded to the stake 38 at the bottom of the housing, and is open-ended at its upper end, which generally coincides horizontally with the upper end of the stake. A flange 54 surrounds the upper open end of the housing 52 and extends outwardly therefrom toward, but short of reaching the outer edges of the base. The bottom of the housing 52 and the underside of the flange 54 are interconnected by a plurality of struts 54' shown in FIGS. 2–5 as angled rods fastened to lower corners of the housing 52 and outer edges of the flange 54. The flange 54 is shown as being square in the plan view, but can be other shapes as well. In the design illustrated, the square flange 54 and the flange 48 of anchor plate 46 are both offset angularly at forty-five degrees from the square base, so that the corners of flange 54 approach the side edges of the base with but a few inches to spare. There are four bolts 50 attaching the plate 46 to the base at the plate corners. Enlarged holes 56 are provided in the flange 54 to permit free passage of the ends of bolts 50 and their nuts through the flange 54 so that the adjacent flanges 54 and 48 come into surface contact when the base is seated on the anchor. The holes 56 also serve as passages to permit sand to be poured into the space 57 between the flange 54 and the top of the concrete 32 after the anchor has been fixed in position.

At the outer periphery of the flange 54, there is provided an upstanding shallow vertical restraining surface 58 which constitutes a primary improvement of this invention over the prior art. The vertical depth of surface 58 has been found to be sufficient at about one-half inch. This corresponds to the thickness of the flange 48 of the anchor plate 46. At the upper edge of the restraining surface 58, a downwardly beveled outer edge 60 is provided. The periphery of the edge 60 is approximately three-quarters of an inch below the uppermost portion of the anchor. Therefore, the bevel provides an inclined ramp so that it would be very difficult to snag any part of the anchor with the dragging equipment, since the lower peripheral edge of the ramp is well below grade, perhaps from an inch to an inch and a half. Drain holes 62 are provided in the lower end of housing 52 so that any water which may enter the housing can flow through.

Referring now to FIG. 3, assume play of a game has been completed and the bases are removed. At that time the cover plates 40 are installed over the stakes in much the same fashion as the bases. Although it is preferred to have some small clearance between the outer surfaces of the receptacle 44 and the inside of the housing 52 for ease of placing a base thereover, it is advantageous to have the cover plate 40 mate both with the stake and the inside walls of the housing 52. As can be seen at 64 in FIG. 4, two or more of the corners of cover plate 40 are angled to enable a prying tool such as a screwdriver to be used to lift the plate 40 from the anchor. This would be done after first removing dirt from above the plate 40. The dirt depth may be of a dimension "z", nominally between one-fourth to three-fourths of an inch depending on how grading proceeded.

The cover plate 40 is preferably molded of polyurethane to give it a resiliency that enables a player to step directly above the plate 40, have his shoe cleats penetrate the dirt but yet not slip, as he could if the plate had a metal surface.

FIGS. 6 and 7 are graphic illustrations of what is achieved by practicing the present invention as compared to the prior art. The prior art showing of FIG. 6 has a lever arm "L" which starts at the outside of the female receptacle and extends to the outside edge of the base when a player sliding into second base, for example, engages the base at the corner indicated by the arrow 70. For a standard base, this lever arm is approximately six and one-half inches. In contrast, with the teaching of the novel anchor of this invention, the lever arm "L" is reduced to approximately two and one-half inches. This results in reduced torque applied by a sliding player, saving wear and tear on the base connecting parts. This places receipt of the main sliding force at the outer restraining edge or surface 58 of the flange 54, where the anchor plate 46 has substantially more body and support than is present at the receptacle 44. At least one manufacturer is known to provide a metal sleeve within the receptacle to protect it from wear and tear during installation and removal of the base as well as potential breakage due to a person sliding into a base. The stake and receptacle of this invention now have a principal function of preventing tipping of the base when standing on it near an edge or a corner. The main brunt of the force applied horizontally to the base by sliding are now absorbed by the restraining surfaces on flanges 54 and 48.

To illustrate that other types of dual male/female connections may be designed to accomplish a primary objective of the invention, there are illustrated three such examples in FIGS. 8–10. In FIG. 8, the beveled outer edge has been eliminated and the restraining surface is formed by the outer periphery of a flange 54*a*, which becomes a male member. The female member is a metal plate 66 sandwiched between the anchor plate 40*a* and the base 18*a*. Plate 66 has a depending periphery 68 which encompasses and mates with the outer periphery of the flange 54*a*.

FIG. 9 shows an anchor plate 46*b* in which the second male/female connection is similar to that of the cover plate 40 and inside of the housing 52 of FIG. 3.

FIG. 10 illustrates an embodiment similar to that of FIG. 9, but with the outer male/female connection being inverted so as to constitute a female receptacle formed in the anchor plate.

Having described our invention, we claim:

1. A permanent anchor for a portable baseball base having an anchor plate fastened to its underside with a central female receptacle extending downwardly from said anchor plate and vertical edge surfaces encompassing said female receptacle, said anchor being firmly positionable in earth along a basepath of a baseball diamond and being entirely below grade of the basepath when so positioned so as not to obstruct performance of dragging equipment used to level the top surface of the basepath when the base is removed, said anchor comprising:

a central, upwardly-extending male stake having an upper end for entering said female receptacle to comprise a first vertical male/female connection when said base and anchor plate are placed over said stake, said female receptacle and male stake overlapping vertically and each being provided with means for essentially restraining the base against relative rotation when the receptacle and stake are engaged;

a vertically-extending housing attached to and surrounding said stake and having a central opening, said housing being open-ended at its upper edge and said upper edge terminating approximately in the same horizontal plane as said upper end of said stake; and said housing having vertical restraining edge surfaces encompassing its upper open end, said restraining surfaces mating with and closely interfitting said vertical edge surfaces of said anchor plate when said receptacle and stake are engaged so as to comprise a second vertical male/female connection located radially outward of said central stake and receptacle.

2. The invention according to claim 1 wherein a horizontal cover plate is provided for said housing and stake when said base is removed from the anchor, the upper surface of said cover plate comprising a surface yieldable to cleats of baseball shoes and being at a level below grade when in covering position.

3. The invention according to claim 1 wherein both said cover plate and said base anchor plate have corresponding surfaces interfitting said stake and said vertical restraining surface.

4. The invention according to claim 1 wherein said anchor plate comprises a flange extending laterally from said female receptacle and wherein said vertical edge surfaces consist of outer vertical edges of said flange.

5. The invention according to claim 1 wherein said second vertical male/female connection comprises male surfaces on one of said housing and anchor plate and female surfaces on the other.

6. The invention according to claim 5 wherein said housing include a horizontal flange interconnecting said central opening and said restraining surface, and wherein said female surfaces of said second vertical connection include said vertical restraining surface.

7. The invention according to claim 6 wherein said vertical restraining edge surfaces have beveled outer edge surfaces extending downwardly and angularly therefrom, whereby to deflect dragging equipment in the event of contact with said beveled edges.

8. The invention according to claim 6 wherein said anchor plate has a plurality of threaded bolts and nuts fastening said anchor plate to said base with the bolt ends protruding downwardly therefrom toward said horizontal flange, and wherein an enlarged hole is provided in said horizontal flange for each such protruding bolt and nut to permit free passage of said bolt ends and nuts through said flange and to further enable the lower surface of said anchor plate to contact and rest on the upper surface of said horizontal flange.

9. The invention according to claim 8 including a plurality of struts interconnecting a lower portion of the exterior of said housing with lower, outer portions of said horizontal flange so as to maintain said housing and flange at right angles to each other.

10. The invention according to claim 1 wherein said housing encloses said stake at the housing end opposite its upper edge, and wherein said housing end is provided with drain holes therein.

11. The invention according to claim 1 wherein a flange extends outwardly and horizontally from said central opening of said housing and wherein each of said base and flange are essentially square in plan view, said flange and base being angularly oriented forty-five degrees about a vertical line through said stake and receptacle when said base is connected to said anchor such that the corners of said flange are midway between adjacent corners of the base.

12. The invention according to claim 11 wherein the corners of said flange extend radially from said stake and substantially the adjacent sides of said base, whereby to provide a relatively large surface at the top of said anchor to enable it to be found easily while covered by earth when below grade.

13. The invention according to claim 1 wherein means is provided for strapping said base and anchor together when initially permanently placing a base anchor in its proper location on a said baseball diamond and positioning said anchor in earth, said strapping means being releasable from above the base once the anchor has been permanently positioned in the earth, whereby said base initially serves as a locating tool for assuring that said stake is vertical, the proper depth below ground level and located the correct distances from adjacent bases.

14. The invention according to claim 1 wherein said housing has vertical walls spaced horizontally from said stake a distance sufficient for the walls to be free of contact with said receptacle during placement of said receptacle on and removal of said receptacle from said stake.

15. A permanent anchor for a portable basball base having an anchor plate fastened to its underside with a central female receptacle extending downwardly from said anchor plate and vertical edge surfaces encompassing said female receptacle, said anchor being firmly positionable in earth along a basepath of a baseball diamond and being entirely below grade of the basepath when so positioned so as not to obstruct performance of dragging equipment used to level the top surface of the basepath when the base is removed, said anchor comprising:

a central, upwardly-extending male stake having an upper end for entering said female receptacle to comprise a first vertical male/female connection when said base and anchor plate are placed over said stake, said female receptacle and male stake overlapping vertically when the receptacle and stake are engaged;

a vertically-extending housing attached to and surrounding said stake and having a central opening, said housing being open-ended at its upper edge and said upper edge terminating approximately in the same horizontal plane as said upper end of said stake; and said housing having vertical restraining edge surfaces encompassing its upper open end, said restraining surfaces mating with and interfitting said vertical edge surfaces of said anchor plate when said receptacle and stake are engaged so as to comprise a second vertical male/female connection located radially outward of said central stake and receptacle.

16. The invention according to claim 15 wherein said male stake and female receptacle are square in cross section.

17. The invention according to claim 15 wherein said vertical restraining edge surfaces have upper edges and beveled outer edge surfaces extending downwardly and angularly therefrom, whereby to deflect dragging equipment in the event of contact with said beveled edge surfaces.

18. The invention according to claim 15 wherein a horizontal flange extends outwardly from the upper edge of said housing, wherein said anchor plate has a plurality of threaded bolts and nuts fastening said anchor plate to said base with the bolt ends protruding downwardly therefrom toward said horizontal flange, and wherein an enlarged hole is provided in said horizontal flange for each such protruding bolt and nut to permit free passage of said bolt ends and nuts through said flange and to further enable the lower surface of said anchor plate to contact and rest on the upper surface of said horizontal flange.

* * * * *